US009663933B2

(12) United States Patent
Chan et al.

(10) Patent No.: US 9,663,933 B2
(45) Date of Patent: May 30, 2017

(54) TOILET APPARATUS

(71) Applicant: Defond Components Limited, Hong Kong (CN)

(72) Inventors: Kai Chi Chan, Hong Kong (CN); Kwok Chiu Yu, Hong Kong (CN); Yu Chi Lok, Hong Kong (CN)

(73) Assignee: DEFOND HOLDINGS (H. K.) CO. LIMITED, Hong Kong (HK)

( * ) Notice: Subject to any disclaimer, the term of this patent is extended or adjusted under 35 U.S.C. 154(b) by 0 days.

(21) Appl. No.: 14/713,418

(22) Filed: May 15, 2015

(65) Prior Publication Data

US 2016/0333561 A1 Nov. 17, 2016

(51) Int. Cl.
*E03D 9/08* (2006.01)
*F24H 1/10* (2006.01)

(52) U.S. Cl.
CPC ..... *E03D 9/08* (2013.01); *F24H 1/101* (2013.01)

(58) Field of Classification Search
CPC . E03D 9/08; E03D 9/085; F25B 21/02; F25B 21/04; F24H 2250/06
See application file for complete search history.

(56) References Cited

U.S. PATENT DOCUMENTS 3,008,300 A * 11/1961 Ryan ..... F24H 4/04 136/204
5,271,104 A * 12/1993 LaTora ..... E03D 9/08 4/420.4
6,226,994 B1 * 5/2001 Yamada ..... F25B 21/02 136/203
6,236,810 B1 * 5/2001 Kadotani ..... F25B 21/02 392/483

* cited by examiner

*Primary Examiner* — Janie Loeppke
(74) *Attorney, Agent, or Firm* — Leydig, Voit & Mayer, Ltd.

(57) ABSTRACT

A toilet apparatus includes a toilet bowl with a seat, a reservoir for containing water for flushing the toilet bowl, and a water jet device including a conduit with an inlet, an outlet, and a nozzle at the outlet and located in the toilet bowl for generating a water jet to clean a user. A thermoelectric heat pump having a cold side in thermal communication with water in the reservoir extracts heat from the water in the reservoir and a hot side in thermal communication with a conduit section of the conduit supplies heat extracted from water in the reservoir and increases the temperature of water flowing through the conduit.

16 Claims, 7 Drawing Sheets

TOILET APPARATUS

The present invention relates to toilet apparatus with water jet cleaning facility.

BACKGROUND OF THE INVENTION

The provision of a water jet in a toilet for washing the lower part of a user's body is becoming increasingly popular. Warm water is preferred in the washing process. Thus, a small and efficient water heater is needed in such a bidet application. Most pre-existing systems invariably make use of a traditional resistance heater, which is not efficient in terms of space and power consumption and often requires use of the AC mains power, which is not recommended in bathrooms.

The invention seeks to mitigate or to at least alleviate such problems or shortcomings by providing new or otherwise improved toilet apparatus.

SUMMARY OF THE INVENTION

According to the invention, there is provided toilet apparatus comprising a toilet bowl with a seat thereon, a reservoir for containing water for flushing the toilet bowl, and a water jet device comprising a conduit with an inlet and an outlet and a nozzle at the outlet and located in the toilet bowl for generating a water jet to clean lower parts of the body of a user seating on the toilet bowl. There is also a thermoelectric heat pump having a cold side operatively in thermal communication with water associated with the reservoir for extracting heat therefrom and a hot side in thermal communication with a conduit section of the conduit for supplying the extracted heat to increase the temperature of water flowing through the conduit.

It is preferred that the thermoelectric heat pump includes a Peltier device.

Preferably, the thermoelectric heat pump includes a first passage associated with the hot side, the first passage being connected with the conduit and acting as the conduit section.

More preferably, the first passage extends within the hot side of the thermoelectric heat pump in a tortuous path.

In a first preferred embodiment, the thermoelectric heat pump is placed on a wall of the reservoir, with the cold side operatively in thermal communication with water in the reservoir.

More preferably, the wall of the reservoir has an aperture through which the thermoelectric heat pump is located with the cold side within or facing inwardly of the reservoir for thermal communication with water in the reservoir.

Further more preferably, the cold side of the thermoelectric heat pump includes a finned or pinned thermal conductor for contact with water in the reservoir.

In a second preferred embodiment, the thermoelectric heat pump includes a second passage associated with the cold side, the second passage having opposite ends connected by respective tubes to communicate with the interior of the reservoir for allowing circulation of water out of and back into the reservoir past the thermoelectric heat pump.

More preferably, one of the conduit section and the second passage surrounds the other of the conduit section and the second passage.

Further more preferably, the second passage has a tubular configuration (water jacket), through which the conduit section extends.

It is preferred that the thermoelectric heat pump comprises at least three Peltier devices which are arranged to surround the conduit section, with their hot sides facing inwardly.

It is further preferred that the thermoelectric heat pump comprises at least three Peltier devices which are arranged to surround the conduit section, with their hot sides facing inwardly.

It is yet further preferred that the thermoelectric heat pump includes at least one outer thermal conductor in contact with the cold sides of the Peltier devices, over which cold sides the second passage extends, and at least one inner thermal conductor in contact with the hot sides of the Peltier devices, over which hot sides the conduit section extends.

It is yet further preferred that at least one of said at least one outer thermal conductor and said at least one inner thermal conductor has an integral tubular construction.

It is yet further preferred that said at least one outer thermal conductor has an integral tubular construction with an outer side surrounded by a water jacket which provides the second passage.

It is yet further preferred that said at least one inner thermal conductor has an integral tubular construction with an inner side including channels, ribs or splines.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
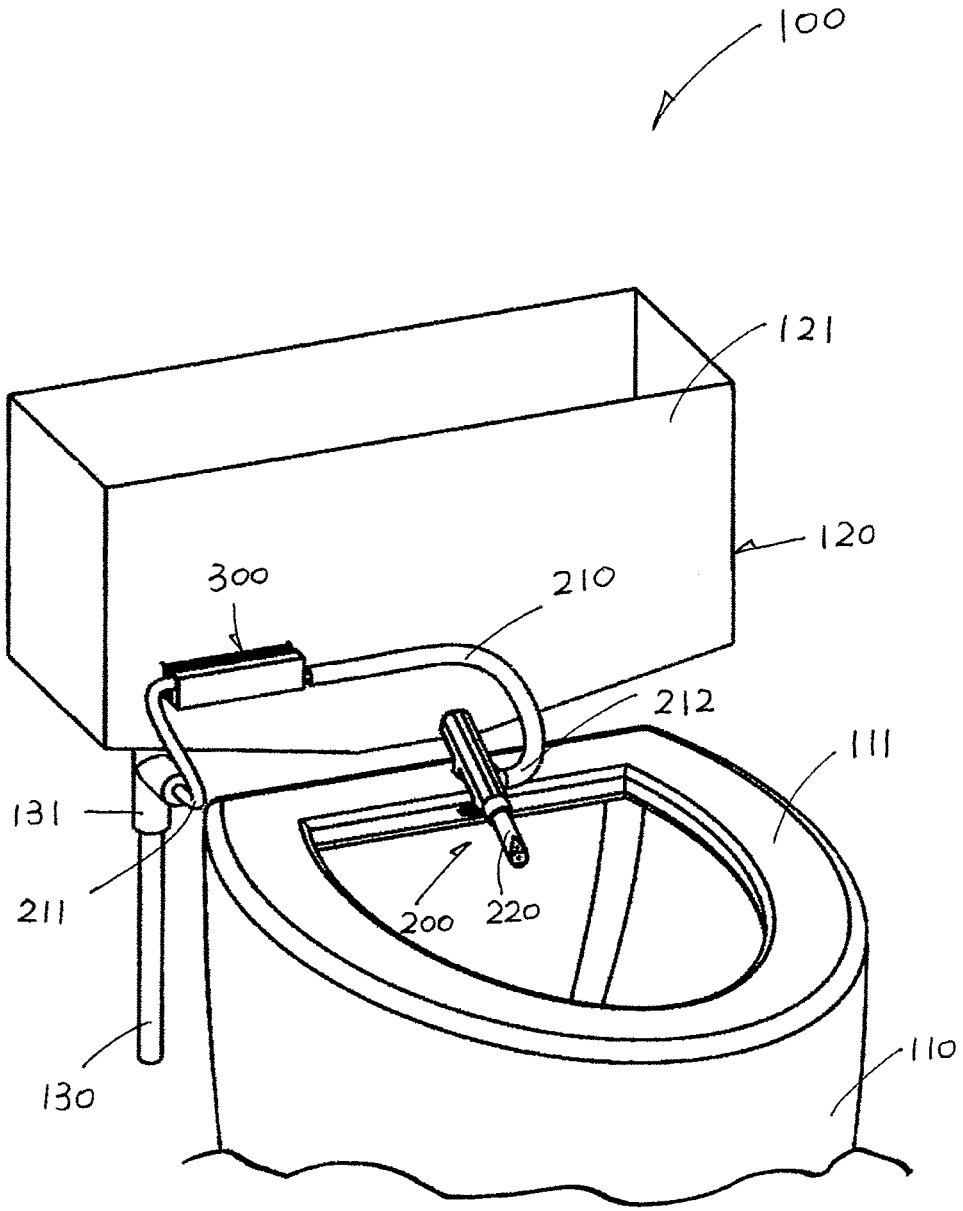
FIG. 1 is a perspective view of a first embodiment of toilet apparatus in accordance with the invention, which includes a water jet device and a thermoelectric heat pump for increasing the temperature of water supplied to the water jet device.

Referring initially to FIGS. 1 to 4 of the drawings, there is shown a first toilet apparatus 100 embodying the invention, which comprises a toilet bowl 110 with a seat 111 thereon, and a reservoir in the form of a water tank 120 for containing water used to flush the toilet bowl 110. There is a water jet device 200 comprising a conduit 210 with an inlet end 211 and an outlet end 212 and a nozzle 220 at the outlet end 212 and located generally in the toilet bowl 110 for generating a water jet 230 to clean lower parts of the body of a user seating on the toilet bowl 110. The inlet end 211 is connected by means of a tee pipe fitting 131 to a fresh water supply pipe 130 which supplies fresh water into the water tank 120 for use as flush water.

Also included is a thermoelectric heat pump 300 having a cold side 310 operatively in thermal communication with water associated with the water tank 120 for extracting heat therefrom and a hot side 320 in thermal communication with a section 213 of the conduit 210 for supplying the extracted heat to increase the temperature of water flowing through the conduit 210 before being ejected out via the nozzle 220.

In general, the thermoelectric heat pump 300 is a solid-state device that produces a heating, cooling or stabilization effect by running a DC electrical current through the device to cause transfer of heat from one side (i.e. the cold side 310) of the device to an opposite side (i.e. the hot side 320) against a temperature gradient. The thermoelectric heat pump 300 acts as an instant water heater that heats water or increases its temperature. According to the present technology, the thermoelectric heat pump 300 is, particularly but not exclusively, implemented by or includes a Peltier device 300P (also known as Peltier cooler or heater) which has a multi-layered structure formed by a middle semi-conductor layer 303 sandwiched by two metal layers 301 and 302 on opposite sides thereof, which act as the cold and hot sides 310 and 320 respectively.

Figure 2:
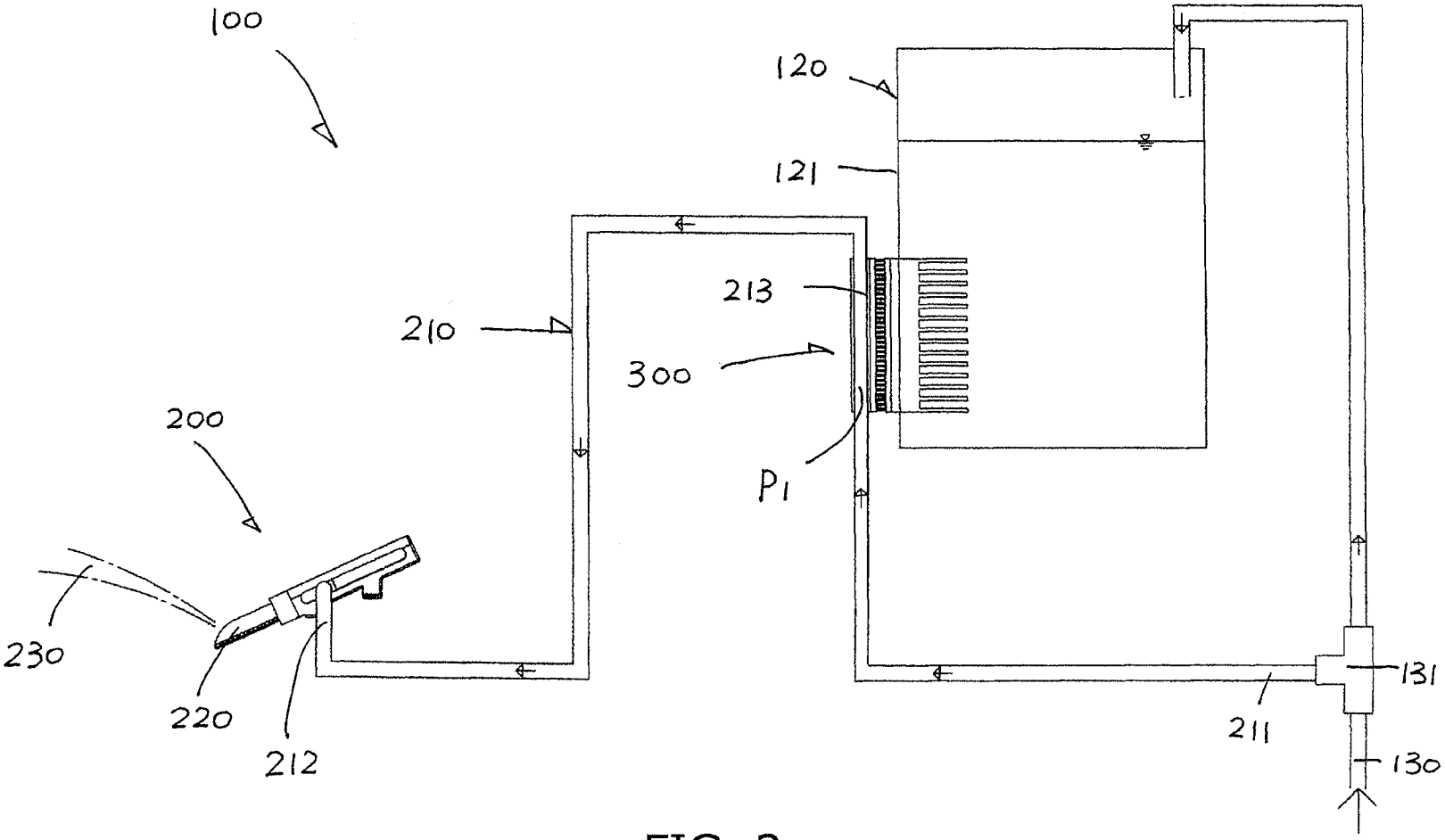
FIG. 2 is a schematic diagram of the toilet apparatus of FIG. 1.
Figure 3:
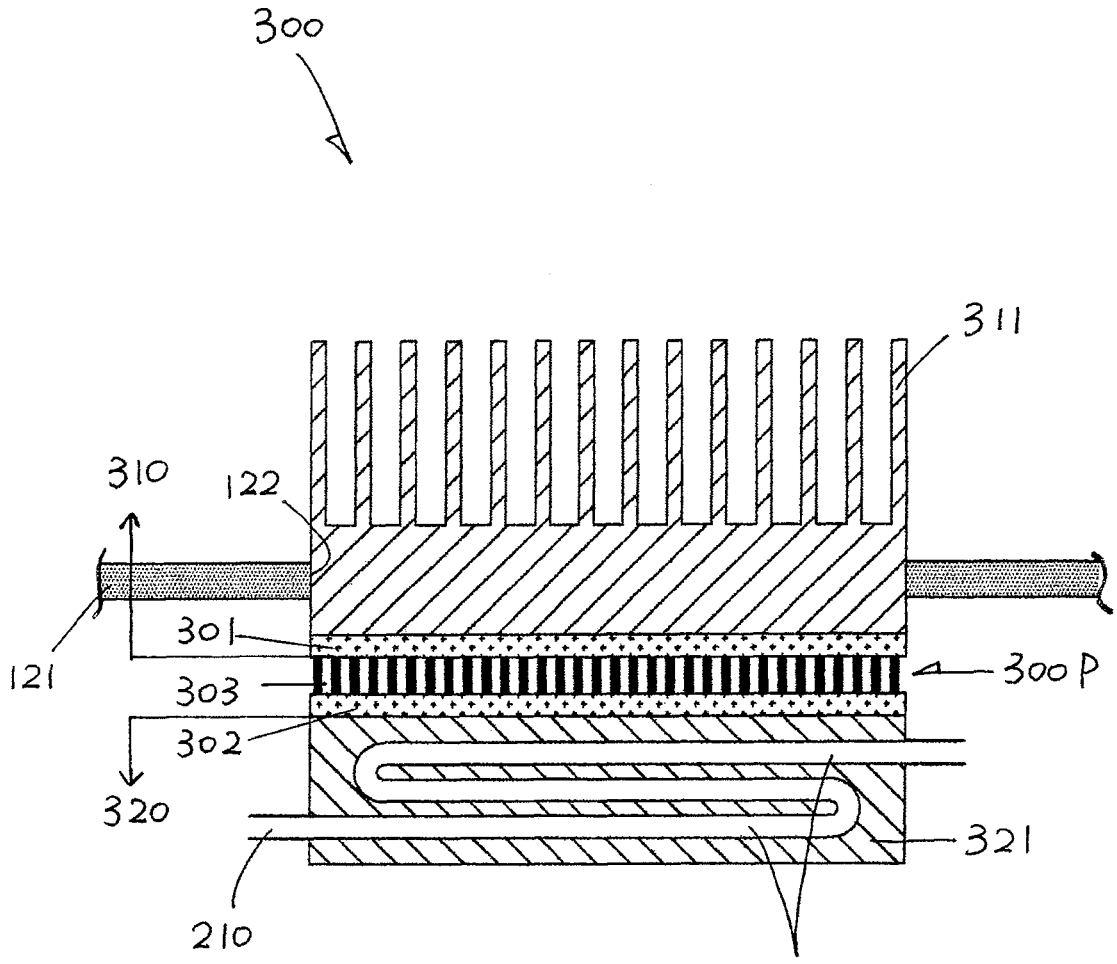
FIG. 3 is a cross-sectional view of the thermoelectric heat pump of FIG. 2.
Figure 4:
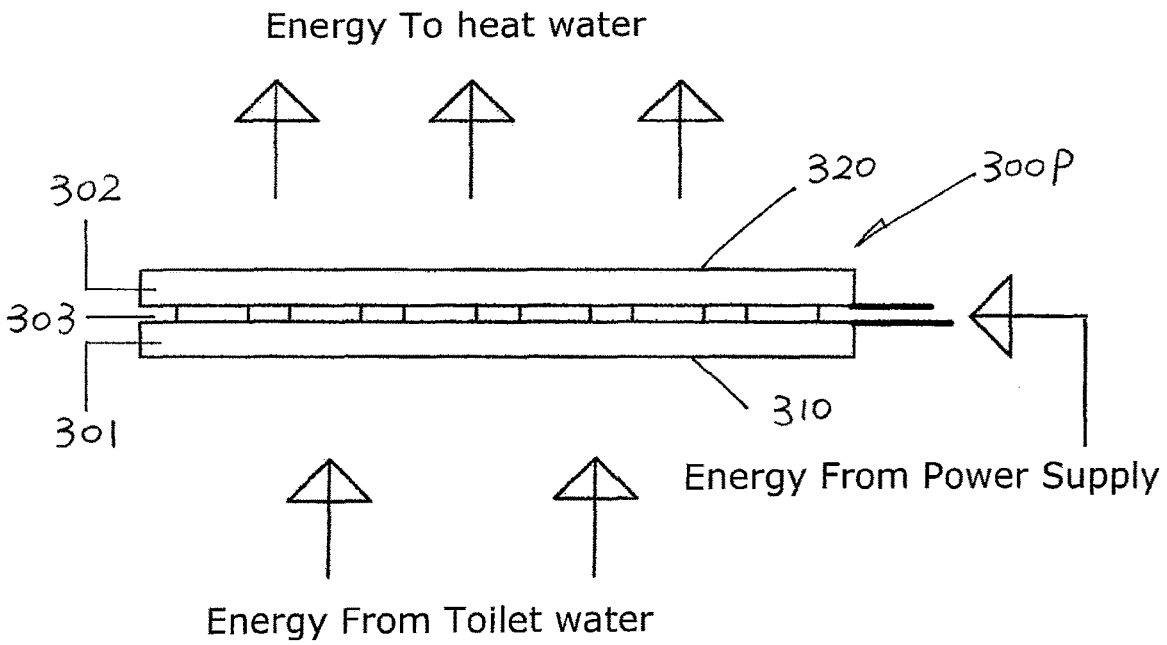
FIG. 4 is a schematic diagram of the thermoelectric heat pump of FIG. 3.
Figure 5:
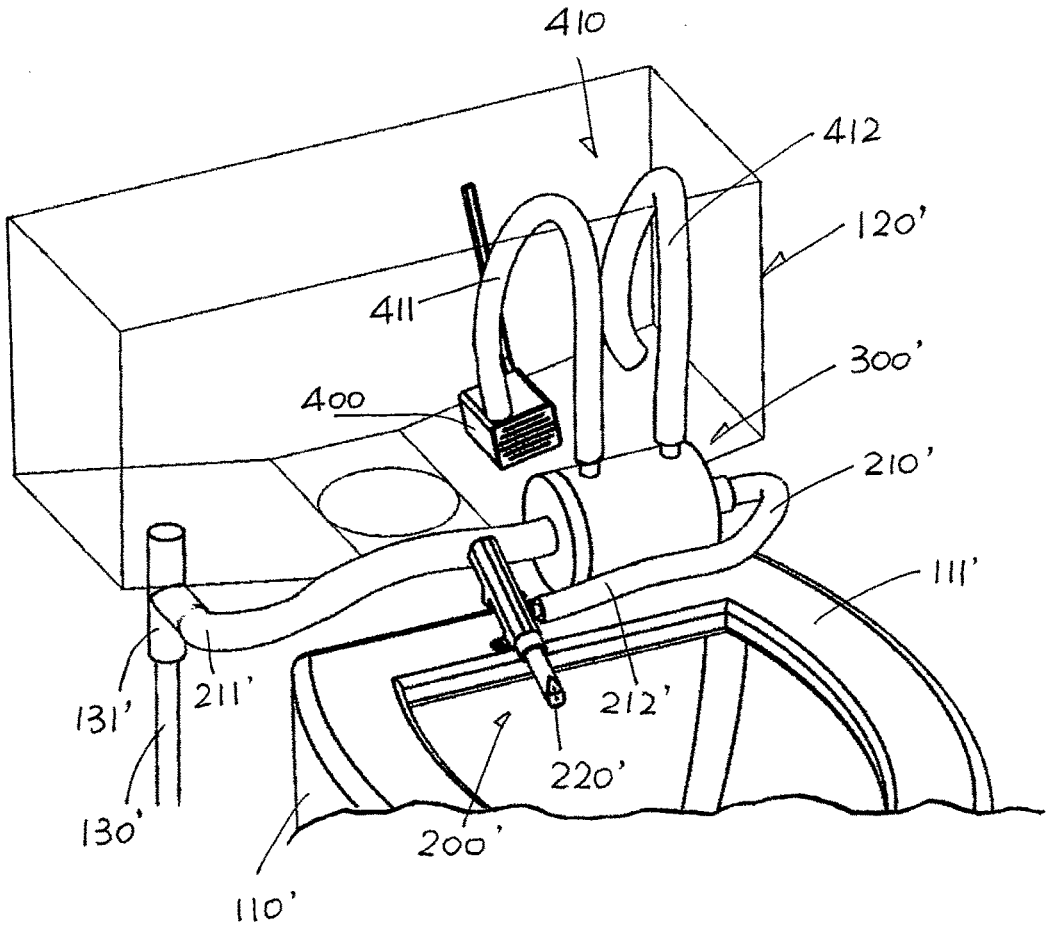
FIG. 5 is a perspective view of a second embodiment of toilet apparatus in accordance with the invention, which includes a water jet device and a thermoelectric heat pump for increasing the temperature of water supplied to the water jet device.
Figure 6:
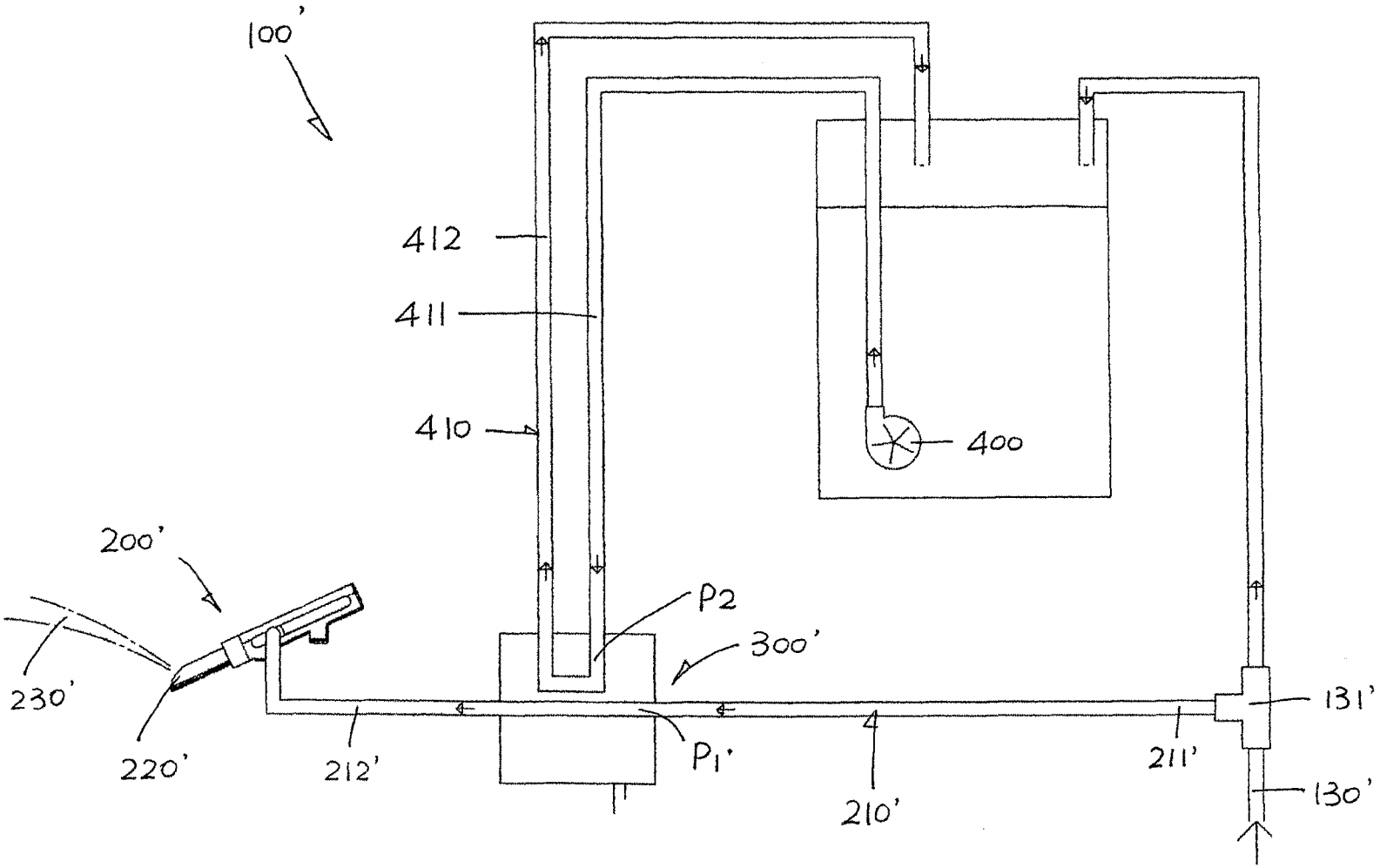
FIG. 6 is a schematic diagram of the toilet apparatus of FIG. 5.
Figure 7:
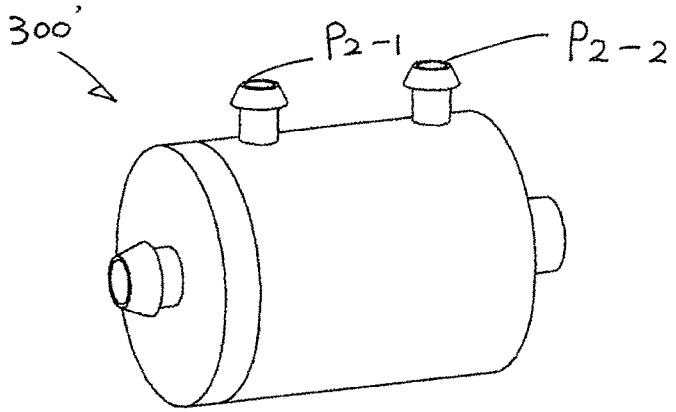
FIG. 7 is a perspective view of the thermoelectric heat pump of FIG. 5.
Figure 8:
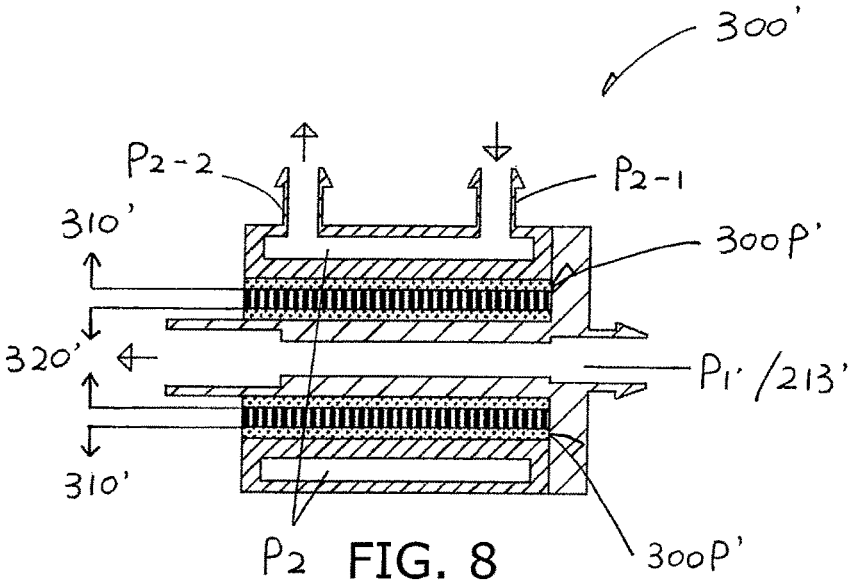
FIG. 8 is a cross-sectional side view of the thermoelectric heat pump of FIG. 7.
Figure 9:
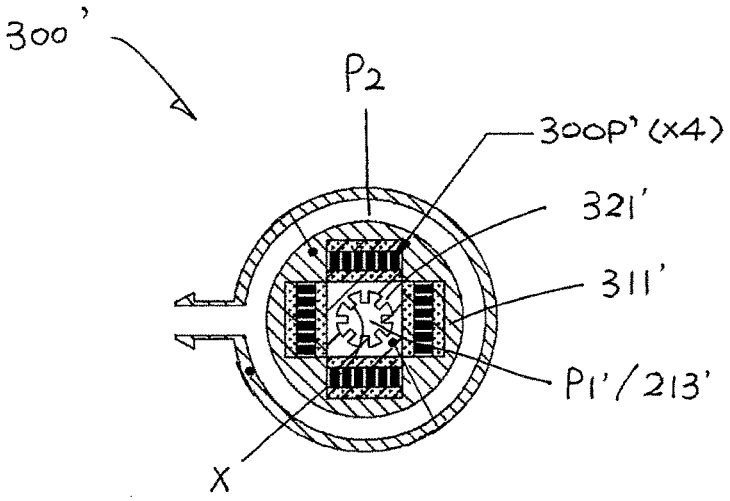
FIG. 9 is a cross-sectional end view of the thermoelectric heat pump of FIG. 7.

In the toilet apparatus 100 of FIG. 2, the thermoelectric heat pump 300 includes a passage P1 which is associated with the hot side 320, by extending through the hot side 320. The passage P1 is connected or jointed with the conduit 210 and acts as the conduit section 213, such that water flowing through the conduit 210, or more precisely the conduit section 213, is heated on the hot side 320 of the thermoelectric heat pump 300 by heat transferred from the cold side 310 of the thermoelectric heat pump 300 in operation.

The thermoelectric heat pump 300 is placed on a wall 121 of the water tank 120, with the cold side 310 operatively in thermal communication with the flush water in the tank 120, via or preferably through the wall 121. Thus, the wall 121 is formed with an aperture 122 through which the thermoelectric heat pump 300 is located with the cold side 310 inserted within (or otherwise facing inwardly of) the water tank 120 for thermal communication with the flush water in the tank 120. The cold side 310 of the thermoelectric heat pump 300 preferably includes a finned or pinned thermal conductor 311 for direct contact with the flush water in the tank 120. The conductor 311 is a heat sink that maximizes the contact area and hence thermal communication or heat exchange between the cold side 310 and the flush water.

The hot side 320 of the thermoelectric heat pump 300 is exposed externally, on which there is attached a thermal conductor block 321. The passage P1 extends through the conductor block 321, i.e. within the hot side of the thermoelectric heat pump 300, in a tortuous path e.g. a multiple Z-fold path, along which the conduit section 213 extends for maximized contact area and hence thermal communication to improve heat exchange between the hot side 320 and the water running to the nozzle 220.

During the operation of the Peltier device 300P, heat from the flush water in the tank 120 is extracted via the finned thermal conductor 311 on the cold side 310 and then transferred or pumped by the Peltier device 300P to the hot side 320 reaching the thermal conductor block 321, which in turn conducts such heat to the conduit section 213 and hence increases the temperature of water flowing through the conduit 210 before exit at the nozzle 220 as a warm water jet 230 to clean lower parts of the body of a user seating on the toilet bowl 110.

The temperature of the water jet 230 can be controlled by adjusting the DC power driving the Peltier device 300P using a digital or analogue controller. The Peltier device 300P extracts heat energy from the flush water in the tank 120, which always maintains itself at the room temperature. As the tank 120 contains a much larger volume of water than the water dispensed via the nozzle 220 per cleaning operation, the water stored in the tank 120 will quickly recover its temperature from the surrounding, thereby representing a virtually unlimited source of heat energy for the present purpose of use.

Reference is now made to FIGS. 5 to 9, there is shown a second toilet apparatus 100' embodying the invention, which has a general construction or arrangement similar to that of the first toilet apparatus 100, with equivalent parts designated by the same reference numerals suffixed by an apostrophe, such as toilet bowl 110' with seat 111', water tank 120', water jet device 200' formed by conduit 210' and nozzle 220', and thermoelectric heat pump 300', etc. This toilet apparatus 100' also operates in a similar manner. The major differences lie in the construction and location of the thermoelectric heat pump 300', as described below.

The thermoelectric heat pump 300' is not mounted on the water tank 120' but is installed elsewhere inconspicuous (e.g. behind the toilet bowl 110'), thereby obviating the need of modifying the water tank 120'. To bring water from within the tank 120' to the thermoelectric heat pump 300', a water pump 400 and a water circuit 410 are added. The water pump 400 is submerged in the water tank 120' for pumping water out. The water circuit 410 is formed by a pair of tubes 411 and 412, with the first tube 411 extending from the pump 400 to the thermoelectric heat pump 300' for delivering water from the tank 120' to the thermoelectric heat pump 300' and the second tube 412 extending from the thermoelectric heat pump 300' back to the tank 120' for returning the water.

The thermoelectric heat pump 300' itself is given a new construction, including a second passage P2 associated with the cold side 310' in addition to the original/first passage P1' associated with the hold side 320'. The second passage P2 serves to let water from the tank 120' via the tube 411 run past the thermoelectric heat pump 300', before returning to the tank 120' via the other tube 412. The second passage P2 has two opposite ends P2-1 and P2-2 connected by the tubes 411 and 412 respectively to communicate with the interior of the water tank 120', thereby allowing circulation of water out of and back into the tank 120' en route past the thermoelectric heat pump 300'.

The second passage P2 has a tubular configuration resembling a cylindrical water jacket, which surrounds the original/first passage P1' and the conduit section 213' or through which the first passage P1' and the conduit section 213' extend, co-axially either way the arrangement is described. The inverted arrangement is possible with suitable changes, such that the second passage P2 is surrounded by the first passage P1' and the conduit section 213'. Hence, in general, one of the conduit section 213' and the second passage P2 surrounds the other of the conduit section 213' and the second passage P2.

The thermoelectric heat pump 300' is formed by at least three Peltier devices 300P' arranged in a triangular manner or, in this particular embodiment, by four Peltier devices 300P' which are arranged in a square formation (FIG. 9) to surround the conduit section 213' that extends along a central axis through the thermoelectric heat pump 300'. These four Peltier devices 300P' are located with their hot sides 320' facing inwardly and their cold sides 310' facing outwardly.

The thermoelectric heat pump 300' further includes an outer thermal conductor 311' in contact with the cold sides 310' of the Peltier devices 300P', over which cold sides 310' the second passage P2 extends, and also an inner thermal conductor 321' in contact with the hot sides 320' of the Peltier devices 300P', over which hot sides 320' the first passage P1' and the conduit section 213' extend. The outer thermal conductor 311' has an integral tubular construction, with an outer side surrounded by a water jacket that provides the second passage P2. The inner thermal conductor 321' likewise has an integral tubular construction, with an inner side that includes axially-extending channels, ribs or splines X to enhance thermal communication with or heat transfer to water flowing through along the conduit section 213' through the first passage P1'.

It is envisaged that each of the outer and inner thermal conductors 311' and 321' may be divided into, or formed by, four quarter-segmental conductors, one for each Peltier device 300P', which are assembled together to achieve the overall cylindrical configuration.

In operation, the second passage P2 serves as an outer heat exchange case which surrounds the first passage P1' that acts as a central heating pipe i.e. the conduit section 213". The second passage P2 is isolated from the first passage P1' by the four Peltier devices 300P', on opposite outer cold side 310' and inner hot side 320' of the Peltier devices 300P'. Flush water from the tank 120' is circulated by the pump 400 past the second passage P2 to supply heat to the outer cold side 310', which heat is then transferred or pumped by the Peltier devices 300P', upon the latter being energized by a DC electrical current, to the inner hot side 320' for subsequent extraction by water in the first passage P1'. The nozzle 220' operates with water flowing along the conduit 210', via the first passage P1' or the conduit section 213' where it is being heated to a suitably higher temperature before exit at the nozzle 220' as a warm water jet 230' to clean lower parts of the body of a user seating on the toilet bowl 110'.

The temperature of the water returning to the tank 120' is lowered due to the heat loss to the water forming the water jet 230'. Since the water tank 120' contains a considerably large volume of water, the overall temperature drop is insignificant. The system is able to maintain a continuous flow of warm water to support the relatively short time operation of the water nozzle 220'.

In general, the Peltier devices 300P/300P' pump and transfer heat from the cold side 310/31o' thereof to the opposite hot side 320/320' upon energization by electrical power which is consumed also in generating heat. Thus, the heat energy obtained on the hot side 320/320' useful in elevating the temperature of water for the bidet application can be higher than the consumed electrical energy. The heating system of the toilet apparatus 100/100' therefore has an enhanced efficiency of heating, in comparison to the use of conventional resistance-type electrical heaters.

The advantages of the thermoelectric heat pump, especially with the use of a Peltier device(s), in the toilet apparatus of the present invention are summarized as follows:

High Efficiency

The Heating Coefficient of Performance (COP) of a Peltier device is about 1.6 whereas the efficiency of traditional resistance heaters is about 0.8-0.9.

Size

No separate water reservoir is needed as a Peltier device is quick to react and able to heat up water instantly.

Continuous Supply of Warm Water

Continuous supply by instant heating accounted by the high heating intensity of a Peltier device Energy Saving Reservoir-type heaters will lose heat to the surrounding over time as water is preheated. Instant heaters, and in particular Peltier devices, only consume power on demand and have nearly no loss to the surrounding.

The Peltier devices 300P/300P' are compact in size and robust in construction and can reliably operate for a relatively long lifespan. Although this is a preferred option according to the subject invention, the use of other kinds of designs of thermoelectric heat pumps, either at present day or in future, is envisaged.

The invention has been given by way of example only, and various other modifications of and/or alterations to the described embodiments may be made by persons skilled in the art without departing from the scope of the invention as specified in the appended claims.

The invention claimed is:

1. A toilet apparatus comprising:

a toilet bowl with a seat;

a reservoir for containing water for flushing the toilet bowl;

a water jet device comprising a conduit with an inlet, an outlet, and a nozzle at the outlet and located in the toilet bowl for generating a water jet to clean a user seated on the seat of the toilet bowl; and a thermoelectric heat pump having a cold side in thermal communication with and extracting heat from water in the reservoir, and a hot side in thermal communication with a conduit section of the conduit for supplying heat extracted from water in the reservoir to water flowing through the conduit section to the nozzle, wherein the thermoelectric heat pump is located on a wall of the reservoir.

2. The toilet apparatus as claimed in claim 1, wherein the thermoelectric heat pump includes a Peltier device.

3. The toilet apparatus as claimed in claim 1, wherein the thermoelectric heat pump includes a passage associated with the hot side, and the passage is in fluid communication with the conduit for flow of water to the conduit section.

4. The toilet apparatus as claimed in claim 3, wherein the passage extends within the hot side of the thermoelectric heat pump in a tortuous path.

5. A The toilet apparatus comprising:

a toilet bowl with a seat;

a reservoir for containing water for flushing the toilet bowl;

a water jet device comprising a conduit with an inlet, an outlet, and a nozzle at the outlet and located in the toilet bowl for generating a water jet to clean a user seated on the seat of the toilet bowl; and a thermoelectric heat pump having a cold side extracting heat from water in the reservoir, and a hot side in thermal communication with a conduit section of the conduit for supplying heat extracted from water in the reservoir to water flowing through the conduit section to the nozzle, wherein a wall of the reservoir has an aperture in which the thermoelectric heat pump is located, with the cold side within or facing inwardly into the reservoir and in thermal communication with water in the reservoir.

6. The toilet apparatus as claimed in claim 5, wherein the cold side of the thermoelectric heat pump includes a finned or pinned thermal conductor in contact with water in the reservoir.

7. The toilet apparatus as claimed in claim 5, wherein the thermoelectric heat pump includes a Peltier device.

8. The toilet apparatus as claimed in claim 5, wherein the thermoelectric heat pump includes passage associated with the hot side, and the passage is in fluid communication with the conduit for flow of water to the conduit section.

9. The toilet apparatus as claimed in claim 8, wherein the passage extends within the hot side of the thermoelectric heat pump in a tortuous path.

10. A toilet apparatus comprising:

a toilet bowl with a seat;

a reservoir for containing water for flushing the toilet bowl;

a water jet device comprising a conduit with an inlet, an outlet, and a nozzle at the outlet and located in the toilet bowl for generating a water jet to clean a user seated on the seat of the toilet bowl;

a thermoelectric heat pump having a cold side in thermal communication with and extracting heat from water extracted from the reservoir, and a hot side in thermal communication with a conduit section of the conduit for supplying heat extracted from water in the reservoir to increase the temperature of water flowing through the conduit, wherein the thermoelectric heat pump includes a first passage associated with the hot side and in fluid communication with the conduit section and located centrally within the thermoelectric heat pump for flow of water heated by the thermoelectric heat pump to the nozzle; and a second passage associated with the cold side surrounding the first passage and the thermoelectric heat pump; and;

a first tube having first and second ends with the first end of the first tube located in the water in the reservoir and the second end of the first tube in fluid communication with a first end of the second passage for extracting water from the reservoir and supplying the water extracted to the second passage, and a second tube having first and second ends with the first end of the second tube in fluid communication with a second end of the second passage and the second end of the second tube in the reservoir for returning water extracted from the reservoir to the reservoir after flow of the water through the second passage over the thermoelectric heat pump.

11. The toilet apparatus as claimed in claimer 10, wherein the second passage has a tubular configuration, through which the conduit section extends.

12. The toilet apparatus as claimed in claim 10, wherein the thermoelectric heat pump comprises at least three Peltier devices which are arranged to surround the conduit section, and each of the Peltier devices includes a hot side and a cold side and the hot sides face inwardly with respect to the conduit section.

13. The toilet apparatus as claimed in claim 12, wherein the thermoelectric heat pump includes at least one outer thermal conductor in contact with the cold sides of the Peltier devices, and the second passage extends over the cold sides of the Peltier devices, and at least one inner thermal conductor in contact with the hot sides of the Peltier devices, and the conduit section extends over the hot sides of the Peltier devices.

14. The toilet apparatus as claimed in claim 13, wherein at least one of the at least one outer thermal conductor and the at least one inner thermal conductor has an integral tubular construction.

15. The toilet apparatus as claimed in claim 14, wherein the at least one outer thermal conductor has an integral tubular construction including an outer side surrounded by a water jacket which provides the second passage.

16. The toilet apparatus as claimed in claim 14, wherein the at least one inner thermal conductor has an integral tubular construction including an inner side having one of channels, ribs, and splines.

* * * * *